US009106987B2

(12) United States Patent
Porter et al.

(10) Patent No.: US 9,106,987 B2
(45) Date of Patent: Aug. 11, 2015

(54) HANDLING POWER DISSIPATION IN A MULTI MICROSPEAKER MODULE

(71) Applicant: Apple Inc., Cupertino, CA (US)

(72) Inventors: Scott P. Porter, Cupertino, CA (US); Christopher Wilk, Cupertino, CA (US); Ruchir M. Dave, San Jose, CA (US)

(73) Assignee: Apple Inc., Cupertino, CA (US)

( * ) Notice: Subject to any disclaimer, the term of this patent is extended or adjusted under 35 U.S.C. 154(b) by 110 days.

(21) Appl. No.: 13/937,056

(22) Filed: Jul. 8, 2013

(65) Prior Publication Data

US 2015/0010175 A1 Jan. 8, 2015

(51) Int. Cl.

| | |
|---|---|
| ***H04R 9/06*** | (2006.01) |
| ***H04R 3/00*** | (2006.01) |
| ***H04R 9/02*** | (2006.01) |
| *H04R 9/00* | (2006.01) |

(52) U.S. Cl.

CPC . *H04R 3/00* (2013.01); *H04R 9/022* (2013.01)

(58) Field of Classification Search

CPC ..... H04R 1/02; H04R 1/021; H04R 1/025; H04R 1/026; H04R 1/12; H04R 1/22; H04R 1/24; H04R 1/26; H04R 1/323; H04R 1/403; H04R 5/02; H04R 7/16; H04R 7/122; H04R 9/022; H04R 9/025; H04R 9/045; H04R 9/06; H04R 9/063

USPC ..... 381/150, 386–389, 396, 398, 412, 433, 381/397

See application file for complete search history.

(56) References Cited

U.S. PATENT DOCUMENTS

| | | | | |
|---|---|---|---|---|
| 5,909,490 | A * | 6/1999 | Sokolich et al. | 381/387 |
| 7,864,977 | B2 * | 1/2011 | Sadaie et al. | 381/396 |
| 8,175,319 | B2 | 5/2012 | Sumitani et al. | |
| 2005/0041831 | A1 | 2/2005 | Stiles et al. | |
| 2006/0188120 | A1 | 8/2006 | Fisher | |

FOREIGN PATENT DOCUMENTS

| | | |
|---|---|---|
| EP | 1545151 | 6/2005 |
| KR | 2007/0010493 | 1/2007 |

OTHER PUBLICATIONS

Hwang, Development of Hi-Fi microspeakers with a woofer and a tweeter used for mobile phones, *Jornal of Applied Physics 97*, 10R512 (2005).

* cited by examiner

*Primary Examiner* — Brian Ensey

(74) *Attorney, Agent, or Firm* — Blakely, Sokoloff, Taylor & Zafman LLP

(57) ABSTRACT

Embodiments of the invention include a micro speaker assembly that has two drivers, each having a separate yoke, set of magnets, voice coil, and acoustic diaphragms. One driver may produce high frequency (HF) sound while the other produces low frequency (LF) sound. The two drivers may be packaged, side-by-side, within the same micro speaker acoustic enclosure. The drivers may have their respective magnet systems physically connected to each other, in order to enhance heat transfer from one to the other. In particular, a thermally conductive portion or bridge may be used to directly join or thermally connect adjacent edges of the yoke portions of the two magnet systems, in order to enhance heat transfer between the first and second micro speaker drivers. Thus, the assembly can handle more power without overheating. Other embodiments are also described and claimed.

21 Claims, 6 Drawing Sheets

HANDLING POWER DISSIPATION IN A MULTI MICROSPEAKER MODULE

FIELD

An embodiment of the invention is related to a technique for managing thermal or power dissipation concerns in a micro speaker assembly that has multiple side-by-side drivers. Other embodiments are also described.

BACKGROUND

Currently, a wide range of portable consumer electronics that are not dedicated to audio playback provide increasingly important audio capabilities. These portable consumer electronics may include, for example, smart phones, laptops, notebooks, tablet computers, and personal digital media players. These portable consumer electronics are often constrained in both x-y area and z-height or thickness such that the speaker driver included therein must be designed to meet the sizing constraints while providing adequate sound quality. Such as speaker assembly might be referred to as a "micro" speaker assembly. The micro speaker assembly may have a micro speaker acoustic chamber housing a micro speaker or micro speaker driver that has at least one dimension that is smaller than 20 millimeters (mm), and an acoustic output port. The acoustic chamber may be a plastic housing referred to as a speaker box, and may create a "back volume" for the micro speaker.

Typically, a micro speaker driver in a portable consumer electronic such as a smart phone includes a coil and a magnet unit and is completely enclosed in the acoustic chamber. One disadvantage of this configuration is that the coil generates heat when audio is being played and the plastic housing traps the generated heat in the speaker driver. If components of the driver or housing exceed a given temperature, they may become damaged, inoperative or melt. In addition, if the magnet unit exceeds a given temperature, the magnet unit may become demagnetized and this will result in terminal damage to the speaker driver.

SUMMARY

Embodiments of the invention include a micro speaker assembly that has at least two drivers or motors, such as two voice coil drivers (e.g., electrodynamic drivers) each having a separate acoustic diaphragm. One driver may be "optimized" or designed for producing high frequency (HF) sound while the other may be optimized for low frequency (LF) sound. The two drivers are packaged, side-by-side, within the same micro speaker acoustic enclosure. Thus, the magnetic systems or yokes of the first and second drivers may be oriented side-by-side, such as by having their yokes lying flat in the same plane without overlapping and by having axes perpendicular to their diaphragms facing in a parallel direction. In some cases, the magnetic systems or yokes of the first and second drivers may be face in a parallel direction, such as by having axes perpendicular to their diaphragms pointing in a parallel direction.

According to embodiments, the two drivers may have their respective magnet systems physically connected to each other, in order to enhance heat transfer from one to the other. In particular, the magnetic yoke portions of the two magnet systems, which yoke portion is made of magnetic material such as a ferrous material, may have flat, plate-like structures. A thermally conductive portion or bridge may directly join the first magnetic system yoke to the second magnetic system yoke in order to enhance heat transfer between the first and second micro speaker drivers.

The yokes may be joined to each other at their edges or sides. The joint may be made using a bridge of thermally conducting material, which may be the same magnetic material that makes up the yokes. It could alternatively be made of a non-magnetic material that exhibits good heat transfer characteristics, e.g. copper. During driver use, this allows heat buildup in the HF driver to be advantageously transferred to the LF driver, where the latter is expected to otherwise run cooler and hence act, in effect, like a heat sink for the HF driver.

According to embodiments, one end of the bridge is disposed below an area between a number of magnets of a first speaker magnet system and a second end of the bridge is disposed below an area between a number of magnets of a second speaker magnet system. This may include the bridge lying flat in the same plane that contains the yoke plate sections of the two drivers; and the bridge between and joining the flat yoke plate sections.

The bridge may include a bar or tie of a ferrous material, a metal material, a copper material, and a steel material that extends between only a portion of the total width of the yokes. According to embodiments, the bridge, first yoke and second yoke may be made of or from a single piece of ferrous material.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

As with all transducers, microspeakers possess inherent limitations, such as due to their reduced size. These limitations are of special concern when considering maximum output metrics. In a typical side ported design the low-frequency response is displacement-limited and the passband is power-limited (the maximum long term power delivered to the transducer should be less than what the amplifier can supply to avoid thermal related failures caused by overheating).

One strategy for addressing the displacement limitation is to implement a two-way design that uses one (usually larger) driver to maintain or extend the low-frequency response such that it is not excursion-limited at maximum drive level. The second driver can reproduce the high frequencies, but improving its power handling capability may not be as easy as tweaking the design since the thermal energy generated in the voice coil is directly related to the drive voltage. Allowing this heat to escape may be difficult at the product level because of 1) constrained product size and 2) flexes and other components insulate the speakerbox from being in good thermal contact with elements that may act as a heat sink (perhaps the enclosure).

Embodiments described herein put the motor structures (e.g., magnetic systems) of both drivers into good thermal contact so that the low-frequency driver may help to act as a thermal mass and heat sink for the high-frequency driver. Thermally, connecting the two motor structures may be done with a variety of methods such a metal pieces, thermally conductive tapes, thermally conductive paste, among others. For certain signals/content, this benefit may work in the opposite of the direction just described. Thus, embodiments described herein provide devices, systems and methods for improving or handling power dissipation in a multi microspeaker module, such as by increasing the amount of power the microspeaker can handle.

Figure 1:
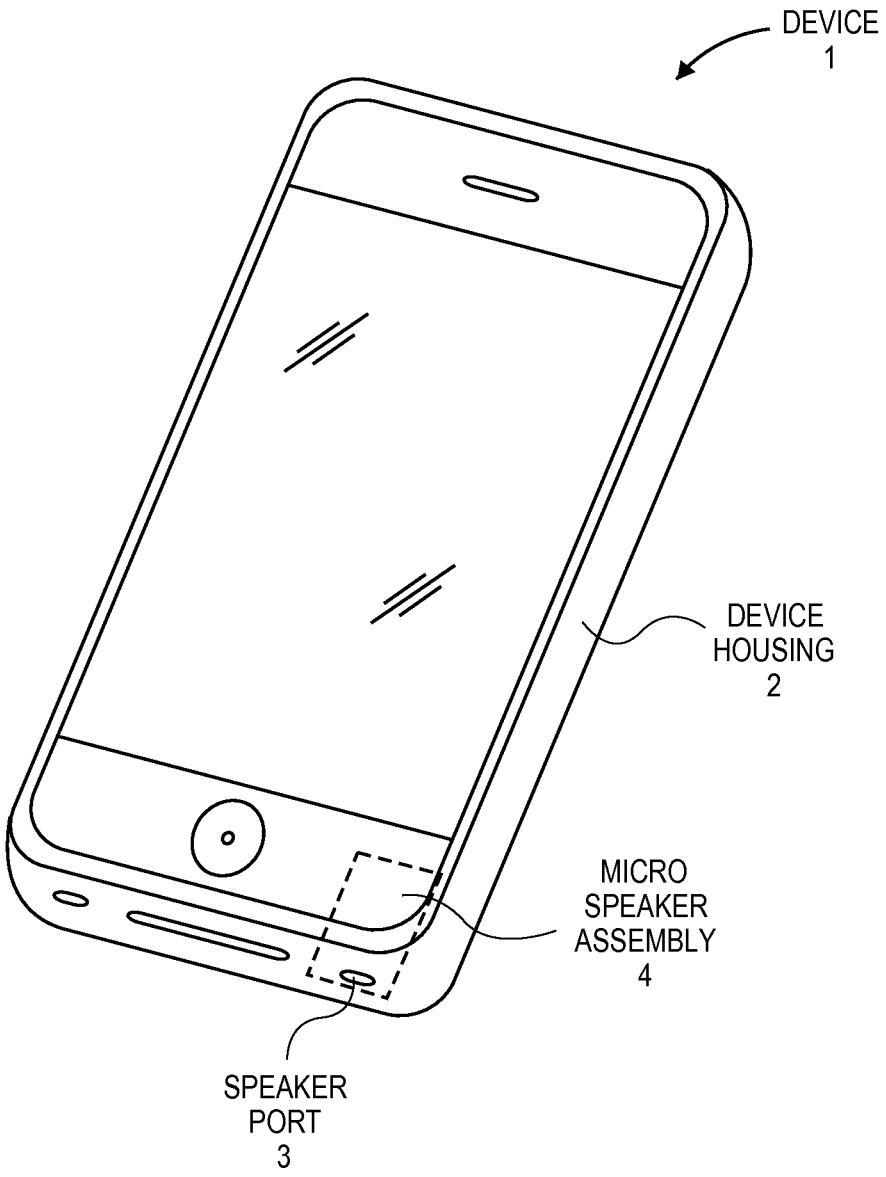
FIG. 1 illustrates one example of a portable consumer electronic device that is constrained in size and thickness and typically uses "micro" speaker assemblies in which embodiments of the invention may be implemented.

FIG. 1 illustrates one example of a portable consumer electronic device (or "mobile device") 1 that may be constrained in size and thickness and typically uses one or more "micro" speaker assemblies (such as assembly 4) in which embodiments of the invention may be implemented. As shown in FIG. 1, the mobile device 1 may be a mobile telephone communications device or a smartphone such as an iPhone™ device, from Apple Inc. of Cupertino, Calif. The mobile device 1 may also be a tablet computer such as an iPad™ device, a personal digital media player such an iPod™ device or a notebook computer such as a MacBook Air™ device, which are all from Apple Inc. of Cupertino, Calif. (e.g., also see FIG. 6). The device housing 2 (also referred to as the external housing) encloses a plurality of electronic components of the device 1 and may have a number of openings through the housing. For example, housing 2 may encloses micro speaker assembly 4 having micro speaker enclosure 5 with speaker port 3 (e.g., an acoustic port) that may be located on the bottom side of the device 1. It is considered that assembly 4 may be located at different locations or have different orientations than that shown in FIG. 1. For example, assembly 4 may be located at (and have port 3 exiting) a different location along the top, bottom or sides of device 1. In some cases, device 1 many include two or more of assembly 4. In some cases, two of assembly 4 may be oriented so that their ports are located near different edges along the top, bottom or sides of device 1, such as to produce stereo sound.

Device 1 may also include electronic components such as a processor, a data storage containing an operating system and application software for execution by the processor, a display panel, and an audio codec providing audio signals to speaker drivers of assembly 4. While FIG. 1 illustrates a mobile device 1, it is understood that embodiments of the invention may also be implemented in a non-mobile device such as a compact desktop computer such as an iMac™, from Apple Inc. of Cupertino, Calif. Micro speaker assembly 4 may house or enclose two or more speaker drivers (e.g., "speakers") having their yokes thermally coupled by a thermally conductive portion or bridge in order to enhance heat transfer between the first and second micro speaker drivers.

Figure 2:
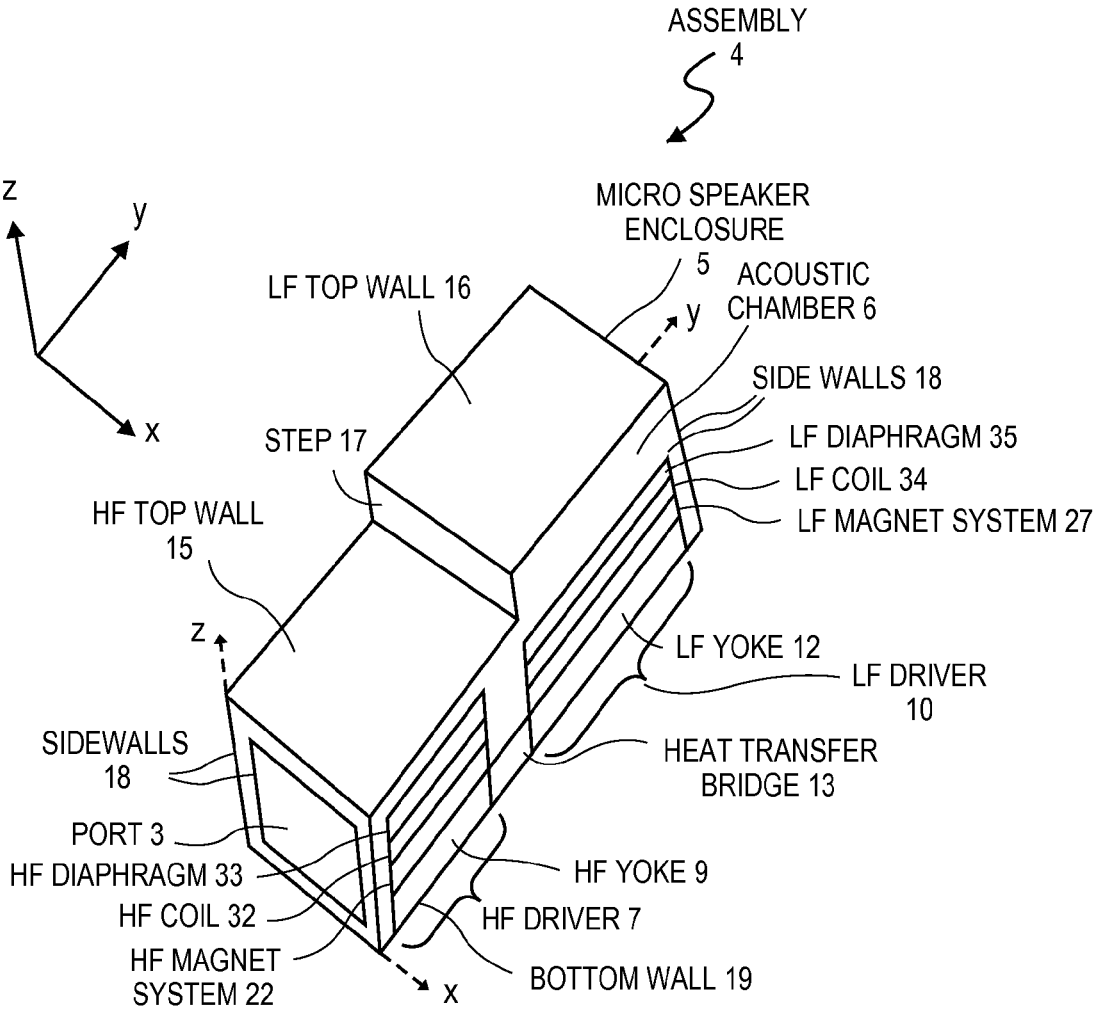
FIG. 2 shows a perspective cross-sectional view of embodiments of a speaker assembly having two speaker drivers having their yokes thermally coupled by a thermally conductive portion or bridge.

FIG. 2 shows a perspective cross-sectional view of embodiments of micro speaker assembly 4 having two speaker drivers having their yokes thermally coupled by a thermally conductive portion or bridge. In some cases, assembly 4 may be described as a "microspeaker module" FIG. 2 shows micro speaker assembly 4 having micro speaker acoustic enclosure 5 with acoustic chamber 6 and speaker port 3 (e.g., an acoustic port). Enclosure 5 may be a plastic housing referred to as a speaker box. Enclosure 5 may be made of a low-conductive or non-conductive material that is relatively inexpensive to precision manufacture (e.g., plastic).

FIG. 2 shows a high frequency (HF) speaker driver 7 located within the enclosure and having HF magnetic system yoke 9. Low frequency (LF) speaker driver 10 is also located within the enclosure and has LF magnetic system yoke 12. Driver 10 may be located "side-by-side" with the driver 7, such as by being mounted on or above a bottom surface or wall of enclosure 5 (e.g., see wall 19 described further below). Thermally conductive portion or bridge 13 is shown directly joining HF system yoke 9 to the LF system yoke 12. The yokes may be joined in order to enhance thermal or heat transfer (e.g., represented by arrows 14) between the first and second speaker drivers (e.g., by heat transfer from one to the other of the yokes). In some embodiments, drivers 7 and 10 may each have at least one dimension that is smaller than 20 millimeters (mm). Acoustic chamber 6 may create or include a "back volume" (e.g., for drivers 7 and 10).

FIG. 2 shows enclosure 5 having HF top wall 15, LF top wall 16 and step 17 between them (e.g., connecting the walls). Enclosure 5 also has side walls 18 and bottom wall 19. Walls 15-19 and step 17 may form a sealed enclosure (e.g., acoustically sealed) with the exception of port 3 (and possibly entries for audio signal wires or circuitry, which may be sealed entries). Step 17 may provide a larger volume or portion of chamber 6 above or around LF driver 10 to increase or assist in its ability to produce a low frequency output of driver 10, as compared to driver 7. Although step 17 is shown as a vertical wall, it may be at an angle with respect to the top surfaces. Bottom wall 19 may be a bottom surface or wall of enclosure 5 upon which or over which (e.g., upon a surface above wall 19) yokes 9 and 12 are mounted.

Bridge 13 may or may not be mounted upon or over wall 19. In some cases bridge 13 is mounted upon the same surface as yokes 9 and 12. In some cases, bridge 13 is free standing, not mounted on a surface, or not attached to a surface. In some cases, bridge 13 is only attached to yokes 9 and 12.

According to some embodiments, yokes 9 and 12, and bridge 13 are mounted in the speakerbox by gluing or insert molding. In some cases, the yokes and bridge 13 are glued to a top surface of bottom wall 19. In some cases, they are glued using known adhesives for attaching yokes or speakers to such a surface of material of wall 19. In some cases, the yokes and bridge 13 are insert molded between (1) bottom surfaces of top walls 15 and 16, and (2) a top surface of bottom wall 19. In some cases, they are molded using known techniques. Such molding may include various other components and layers between the walls and the yokes and speakers. This may include components and layers described herein, as well as additional components and layers. Although FIG. 2 shows port 3 in a "side firing" orientation, other orientations are considered, such as "on-axis firing". Also, other shapes and configurations are considered for enclosure 5, such as an enclosure without a step, or with a different shape.

One purpose for using two drivers (e.g., drivers 7 and 10) in assembly 4 may be to increase output audio frequency range (e.g., output from port 3). For many portable devices, such as mobile phones, high performance micro speakers with broader frequency range are used to realize various multimedia functions such as MP3 playback, speaker phones, and 64 poly-harmonic melody. The operating frequency range of conventional micro speakers is typically from 900 Hz to 10 kHz. However, in many cases, that of 400 Hz to 10 kHz for hi-fi micro speakers is required to meet customer demand in a multimedia era. Thus, it may be possible to achieve the wider range using an assembly that houses a two-way micro speaker having a lower frequency driver or "subwoofer" (e.g., driver 10) and a higher frequency driver or "tweeter" (e.g., driver 7) within one assembly or acoustic enclosure (e.g., enclosure 5). The drivers may share or receive the same audio electronic signals, or may receive signals after "crossover" signal processing which processes or filters a combined frequency range signal to send a higher and a lower filtered frequency range to each of the HF and LF divers, respectively (e.g., as known in the industry).

Heat may be generated by the magnetic system and/or voice coil of the drivers when device 1 is using assembly 4 to produce sound. Such use may include a CODEC of device 1 is sending electronic audio signals to drivers 7 and 10 (e.g., through their voice coils). Due to the physics of the drivers and/or electronic signals powering the drivers, one driver may generate or create more heat than the other. For example HF driver 7 may generate more heat than LF driver 10 in most instances when device 1 is using assembly 4 to produce sound, output at port 3. As shown in FIG. 2, HF and LF driver yokes 9 and 12 are thermally coupled by thermally conductive portion or bridge 13, such as to enhance heat transfer 14 from first to the second speaker drivers (or vice versa). In some cases bridge 13, enhances heat transfer 14 by being thermally coupled between the first and second yokes 9 and 12.

Figure 3:
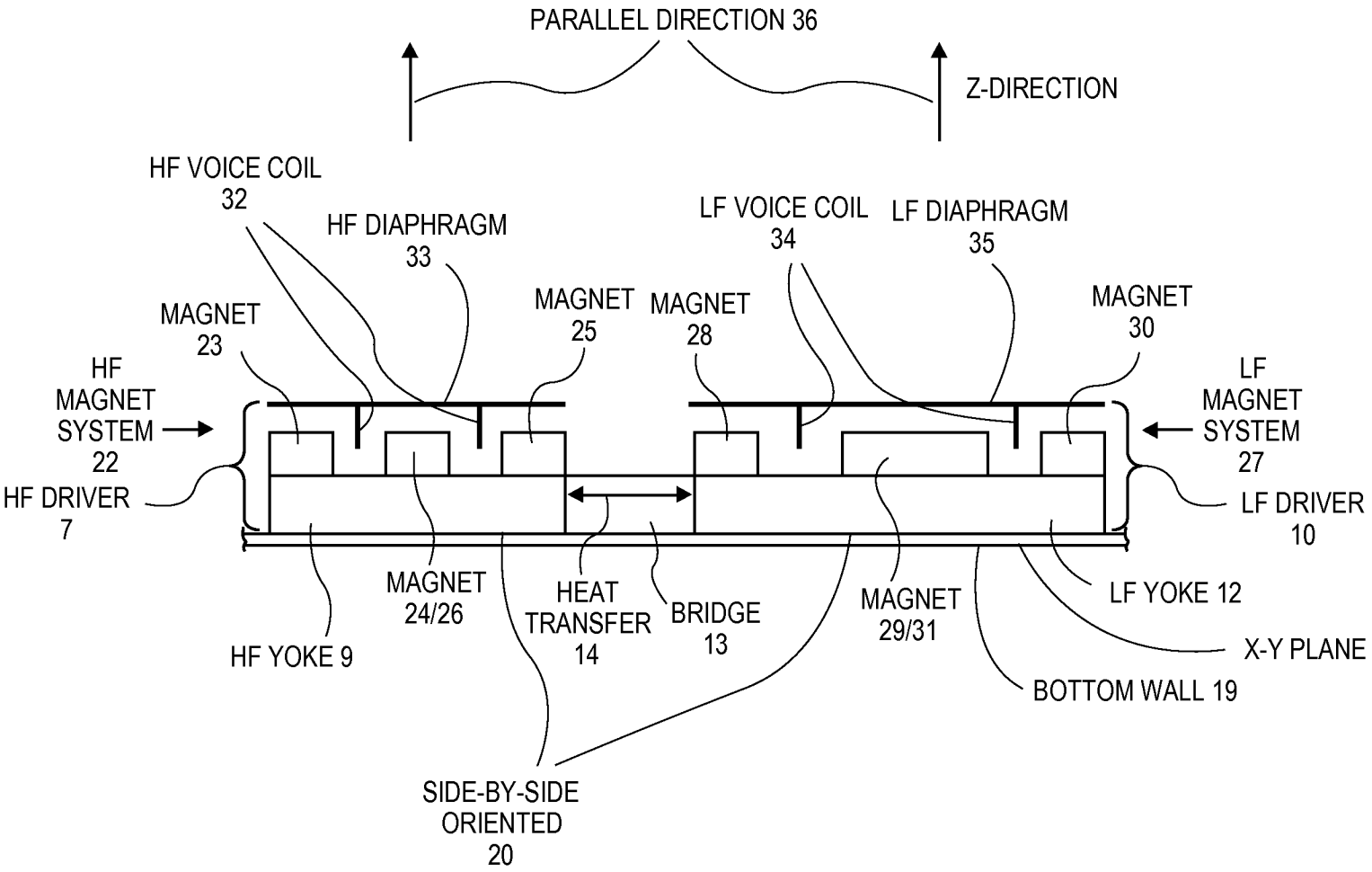
FIG. 3 shows a side cross-sectional view of embodiments of two speaker drivers having their yokes thermally coupled by a thermally conductive portion or bridge.

FIG. 3 shows a side cross-sectional view of embodiments of two speaker drivers 7 and 10 having their yokes 9 and 12 thermally coupled by a thermally conductive portion or bridge 13, such as to enhance heat transfer between drivers 7 and 10. The drivers may share vibration space or acoustic chamber 6 of enclosure 5.

In some embodiments, drivers 7 and 10 are in "side-by-side" orientation 20, which may include having them mounted on or attached to the same planar surface (e.g., a surface on or above wall 19). In some cases, side-by-side orientation 20 includes having drivers 7 and 10 next to or adjacent to each other so that their voice coils, magnet systems and diaphragms do not overlap each other in the x-y plane, where each driver lies flat in the x-y plane. In some cases, side-by-side orientation 20 includes having drivers 7 and 10 lying flat in the same plane (e.g., the x-y plane) without any portion of drivers 7 and 10 overlapping in that plane (e.g., without any overlap in the z direction).

In some embodiments, drivers 7 and 10 are said to be oriented in a "parallel direction", such as by each having a vertical axis that is perpendicular to the surface of their diaphragms (or yokes) pointing in parallel direction 36 (e.g., the z direction with respect to the x, y, z coordinate system). Being oriented in parallel direction 36 may also include having the drivers mounted on or attached to the same planar surface (e.g., a surface of or above wall 19).

In some embodiments, drivers 7 and 10 are in "side-by-side" orientation 20 and are oriented in a "parallel direction". According to embodiments, any of the orientations of drivers 7 and 10 described above may include having drivers 7 and 10 mounted on or attached to the same planar surface (e.g., a surface of or above wall 19), such as by an adhesive, glue, tape or other attachment as known in the art.

FIG. 3 shows HF system yoke 9 attached or coupled to HF speaker magnet system 21 that is disposed around HF voice coil 32. HF coil 32 is attached or coupled HF acoustic diaphragm 33. In the example of FIG. 3, HF speaker magnet system 21 is shown including magnets 23-26. FIG. 3 also shows LF system yoke 12 attached or coupled to LF speaker magnet system 27 that is disposed around LF voice coil 34. LF coil 34 is attached or coupled LF acoustic diaphragm 35. In the example of FIG. 3, LF speaker magnet system 27 is shown including magnets 28-31.

In some cases, coils 32 and 34 may each be suspended by a former or web (not shown) with respect to yokes 9 and 12 and/or magnets systems 21 and 28, respectively. In some cases, diaphragms 33 and 35 may each be suspended by a suspension (not shown) with components of drivers 7 and 10 and/or enclosure 5 (e.g., walls of the enclosure).

In some cases, acoustic diaphragms 33 and 35 are in "side-by-side" orientation 20, which may include having them mounted on or attached to drivers 7 and 10 above the same planar surface (e.g., a surface on or above wall 19). In some cases, this includes having diaphragms 33 and 35 next to or adjacent to each other so that their surfaces do not overlap each other in the x-y plane, where each diaphragm lies flat in the x-y plane. In some cases, this includes having diaphragms 33 and 35 lying flat in the same plane (e.g., the x-y plane) without any portion of diaphragms 33 and 35 overlapping in that plane (e.g., without any overlap in the z direction). In some cases, acoustic diaphragms 33 and 35 are oriented in parallel direction 36, such as by each having a vertical axis that is perpendicular to the surface of the diaphragm pointing in parallel direction 36 (e.g., the z direction with respect to the x, y, z coordinate system).

In some embodiments, diaphragms 33 and 35 are in "side-by-side" orientation 20 and are oriented in a "parallel direction". According to embodiments, any of the orientations of diaphragms 33 and 35 described above may include having drivers 7 and 10 mounted on or attached to a surface of or above to the same planar surface (e.g., wall 19), such as by an adhesive, glue, tape or other attachment as known in the art.

LF driver 10 may be configured to provide a lower frequency audio output than the HF driver 7. In some cases, LF acoustic diaphragm 35 may be configured to provide a lower frequency output than the HF diaphragm 33, such as by having a larger surface area or mass than that of diaphragm 33.

Figure 4:
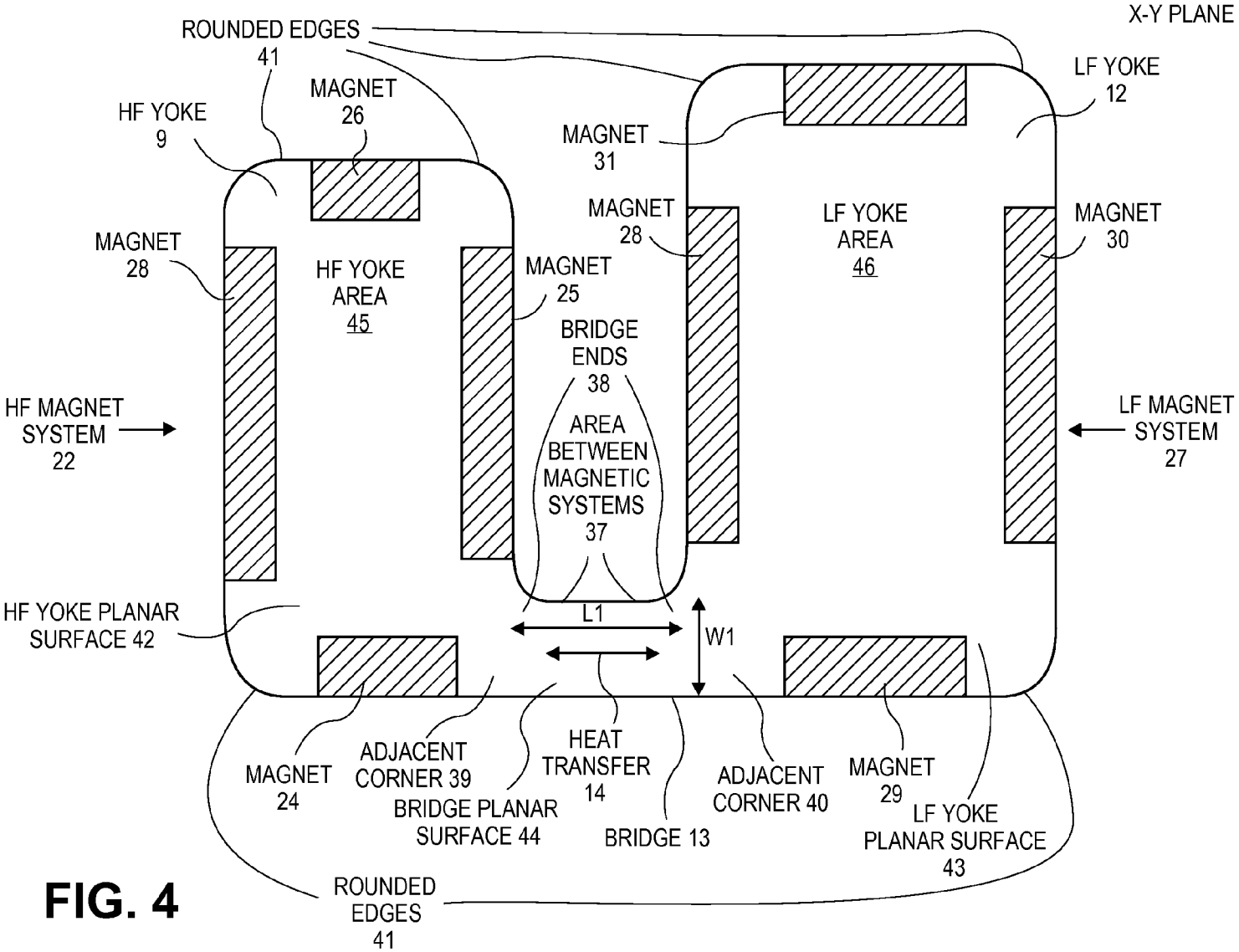
FIG. 4 shows a top view of embodiments of two speaker driver yokes thermally coupled by a thermally conductive portion or bridge.

FIG. 4 shows a top view of embodiments of two speaker driver yokes 9 and 12 thermally coupled by a thermally conductive portion or bridge 13. FIG. 4 shows magnet systems 22 and 27 mounted on yokes 9 and 12, respectively. In the example of FIG. 4, HF magnet system 22 includes individual or separated magnets 23, 24, 25 and 26. In the example of FIG. 4, LF magnet system 27 includes individual or separated magnets 28, 29, 30 and 31. In some embodiments, magnet systems 22 and 27 may be or include one or more permanent magnet pieces (e.g., magnets 23, 24, 25, 26, 28, 29, 30 and 31), such as shown in FIG. 3-4, with gaps between them (e.g., gaps in the x-y plane). Bridge 13 may join the yoke plates at the adjacent corners where there is a gap between two magnet pieces (e.g., pieces for each yoke).

It is considered that other numbers of magnets or magnet configurations may be used for systems 22 and 27. In some cases 3, 5, 6, or 8 magnets may be used for each system. In some cases a solid full or partial ring of magnetic material may be used for each system.

Magnet systems 22 and 27 (e.g., each magnet) may be mounted on or attached to yokes 9 and 12 such as by an adhesive, glue tape, or other attachment as known in the art. In some cases there may be other components between the magnet systems and yokes 9 and 12, such that the magnet systems are disposed above, or mounted on a surface above yokes 9 and 12.

Thermally conductive portion or bridge 13 may be disposed below (e.g., in the z-direction) area 37 between magnets of magnet systems 22 and 27. This may include one end of the bridge (e.g., one of ends 38) being located below an area that is not overlapping in the z-direction with the location of any of the magnets of magnet system 22, and the other end of the bridge (e.g., the other of ends 38) being located below an area that is not overlapping in the z-direction with the location of any of the magnets of magnet system 27. According to embodiments, the bridge may be located below an area that is between (e.g., not overlapping in the z direction) individual or separated magnets 23, 24, 25 and 26 and between magnets 28, 29, 30 and 31. This may include the bridge lying flat in the same x-y plane that contains the yoke plate sections of the two drivers; and the bridge between and joining a portion or section of one of the sides of each of the flat yoke plate sections that does not contain (e.g., is not below, in the z-direction) any of the magnets of magnet systems 22 and 27. This may include all of the bridge that touches or is attached to each yoke being located below an area that is between (e.g., not overlapping in the z direction) and that does not contain (e.g., is not below, in the z-direction) any of the magnets of magnet systems 22 and 27 (e.g., any of magnets 23, 24, 25, 26, 28, 29, 30 and 31 in the example of FIGS. 3-4).

In some cases, bridge 13 may be defined by or fill an area that is between magnet systems 22 and 27. In some cases, the area of bridge 13 excludes or does not have any of the magnets of the systems mounted on or disposed above the area occupied by bridge 13 (e.g., from a top perspective view, such as that of FIG. 4).

FIG. 4 shows HF yoke 9 having planar top surface 42 with area 45. LF yoke 12 is shown having planar top surface 43 with area 46. Bridge 13 is shown having planar top surface 44. Planar surfaces 42 and 43 may be oriented parallel to each other, such as by being in the same plane. In some cases, planar surface 44 is oriented "side by side" and/or parallel to planar surfaces 42 and 43 (e.g., as described herein). In some embodiments, yokes 9 and 12 are in "side-by-side" orientation 20, such as by having their back or front surfaces aligned along the same plane. In some case, this includes having the yokes mounted on or attached to the same planar surface (e.g., a surface on or above wall 19). In some cases, this includes having yokes 9 and 12 next to or adjacent to each other so that their surfaces do not overlap each other in the x-y plane, where each yoke lies flat in the x-y plane. In some cases, this includes having yokes 9 and 12 lying flat in the same plane (e.g., the x-y plane) without any portion of yokes 9 and 12 overlapping in that plane (e.g., without any overlap in the z direction).

In some cases, yokes 9 and 12 are oriented in parallel direction 36, such as by each having a vertical axis that is perpendicular to the back or front surface of the yoke pointing in parallel direction 36 (e.g., the z-direction with respect to the x, y, z coordinate system). Being oriented in parallel direction 36 may also include having the yokes mounted on or attached to the same planar surface (e.g., a surface of or above wall 19).

In some embodiments, yokes 9 and 12 are in "side-by-side" orientation 20 and are oriented in a "parallel direction". According to embodiments, any of the orientations of yokes 9 and 12 described above may include having drivers 7 and 10 mounted on or attached to the same planar surface (e.g., a surface of or above wall 19), such as by an adhesive, glue, tape or other attachment as known in the art.

Yokes 9 and 12 are shown having three rounded edges or corners 41. In some cases, they may have a two or more, or all their corners or edges rounded. Each of yokes 9 and 12 have at least one edge or corner directly joined to opposite ends of bridge 13, such as to enhance heat transfer between the first and second speaker drivers. FIG. 4 shows yokes 9 and 12 having adjacent and/or opposing corners 39 and 40 directly joined to opposite ends 38 of bridge 13. In some cases being directly joined is or includes: being directly attached without any structure in between, touching, being part of, being formed onto, or being bonded such as by an adhesive, glue or tape. In some cases, bridge 13 is thermally coupled, connected, or attached to yokes 9 and 12. In some embodiments, bridge 13 is or includes a thermally conductive bridge disposed between, directly joining and thermally coupled to adjacent corners 39 and 40 of yokes 9 and 12 in order to enhance heat transfer between those yokes.

In some embodiments, bridge 13 is or includes a ferromagnetic material, while in other embodiments it does not. In some embodiments, bridge 13 is or includes a thermally conductive material such as a ferrous material, a metal material, a copper material, a steel material, a solder material, or a combination thereof (e.g., such as an alloy). It is also considered that bridge 13 may be or include metal pieces, thermally conductive tapes, thermally conductive paste, and/or other conductive materials. In some embodiments, bridge 13 is or includes a bar, bridge, or tie of such material.

In some cases, bridge 13, yoke 9 and yoke 12 are a single piece of the same material, such as of a ferrous material. It is considered that bridge 13, yoke 9 and yoke 12 may be formed together during a manufacturing process, such as by being molded, cast, etched or cut from a single piece or layer of material.

Bridge 13 may define a rectangular, square or other shaped area (e.g., from above, such as shown in FIG. 4). In some cases, bridge 13 has a slight U shape from above. Bridge 13 may define a rectangular, square or other shaped cross-section (e.g., from the side, such as shown in FIG. 3). In some of these cases, bridge 13 might be the same material as the yokes, such as by being formed of the same material at the same time as when the yokes are formed.

In some cases, bridge 13 has a rounded, oval, circular or bowed shape from the side. In some cases, bridge 13 has a rounded, oval, circular or bowed shape from above. In some of these cases, bridge 13 might be a different material than the yokes, such as by being formed of a material deposited or added between the yokes, after the yokes are formed.

In some embodiments, bridge 13 fills or extends across only a portion or part of the total area between the yokes, where the total area is described by an area extending from along the entire edge of area 45 that is facing area 46 to along the entire edge of area 46 that is facing area 45. For instance, bridge 13 may fill or extend across only 5, 10, 15, 20, 25 or 30 percent of this area. It is also considered that bridge 13 may have a thickness of between 0.1 and 2 mm, a width W1 (e.g., vertical width of bridge extending from or between corner 39 to 40) of between 2 and 10 mm, and a length L1 (e.g., distance or separation extending between corner 39 to 40) of between 3 and 30 mm. According to some embodiments, bridge 13 provides sufficient amount of thermal conductivity or heat transfer between yokes 9 and 12 so as to keep their temperatures within 5, 10 or 20 degrees Fahrenheit, during use.

FIG. 4 shows magnet systems 22 and 27 mounted on yokes 9 and 12, respectively. HF magnet system 22 includes individual or separated magnets 23, 24, 25 and 26 which form a magnetic field that interacts with an audio signal electrical current (e.g., from a CODEC of device 1) that is sent or runs through HF voice coil 32. The electromagnetic interaction between the magnetic field and electronic signal cause vibrations in HF coil 32, and thus in HF diaphragm 33 (e.g., a sound radiating surface—SRS) that create the HF sound produced by driver 7. LF magnet system 27 includes individual or separated magnets 28, 29, 30 and 31 which form a magnetic field that interacts with an audio signal electrical current (e.g., from a CODEC of device 1) that is sent or runs through LF voice coil 34. The electromagnetic interaction between the magnetic field and electronic signal cause vibrations in coil LF 34, and thus in LF diaphragm 35 that create the HF sound produced by driver 7.

FIG. 4 shows HF and LF driver yokes 9 and 12 thermally coupled by a thermally conductive portion or bridge 13, such as to enhance heat transfer 14 between the first and second speaker drivers. In some cases bridge 13, such as to enhance heat transfer 14 between the first and second yokes 9 and 12, which are thermally coupled to the voice coils 32 and 34. For example, when HF coil 32 is producing more heat than LF coil 34, the increased heat in HF driver 7 (e.g., an amount of heat greater than that of LF driver 10) may be conducted to yoke 9, and in turn conducted through bridge 13 to yoke 12. More specifically, when HF coil 32 is hotter than LF coil 34, the increased heat in components of HF driver 7 (such as magnet system 27 which may act as a thermal sink or reservoir) may be conducted to yoke 9, and in turn conducted through bridge 13 to yoke 12 and other components of LF driver 10 (such as magnet system 22 which may act as a thermal sink). Such a heat transfer may also occur in instances where driver 7 and/or yoke 9 are warmer or hotter than driver 10 and/or yoke 12.

It is also considered that the heat transfer may occur in the opposite direction. This may occur when LF coil 34 is producing more heat than HF coil 32; or in instances where driver 7 and/or yoke 9 are cooler than driver 10 and/or yoke 12.

Micro speaker drivers 7 and 10 may be micro speakers with a size as know in the art. Such a driver may be between 5 and 30 mm wide or across (e.g., from end to end across its longest surface). In some cases, a micro-speaker may be called a mini speaker, or miniature speaker. In some cases, a micro-speaker may be defined as any mini speaker where at least one dimension is 20 mm or less (e.g., a distance across areas 45 and 46 of FIG. 4).

Enclosure 5 and assembly 4 may be designed to properly house two of such drivers. In some cases, the height or rise of enclosure 5 may be in the range of about 1 millimeters (mm) to about 10 mm and the speaker back volume or acoustic chamber may be in the range of about 0.1 cubic centimeters (cm) to 2 cubic cm. The concepts described here, however, need not be limited to speaker enclosures whose rise and back volume are within these ranges.

Area 46 of LF yoke 12 may be larger than that of area 45 of HF yoke 9 to cause driver 7 to provide a lower frequency audio output than that of HF driver 7 due to the difference in area. In some cases, the area of LF acoustic diaphragm 35 is based on or proportional to area 46, and the area of HF acoustic diaphragm 33 is based on or proportional to area 45. This may cause LF acoustic diaphragm 35 to provide a lower frequency output than the HF diaphragm 33.

Drivers 7 and 10, or components thereof (e.g., yokes, magnet systems, coils, and/or diaphragms) may be formed in a disk shape, an oval shape, or a rounded rectangle shape. In some cases, they may have a two or more, or all their corners or edges rounded. In some cases, yokes 9 and 12 have a similar shape, while in other cases they may have different shapes (e.g., from above, such as defining areas 45 and 46). Yokes 9 and 12 may be shaped as a circle, an oval, a rounded square, or a rounded rectangle, or a shape as known for a yoke.

In some embodiments, yokes 9 and 12 may be described as magnetic plates, back plates, base plates or micro speaker yokes. In some embodiments, drivers 7 and 10 may be described as micro speakers, acoustic transducers, having voice coil motors, or electrodynamic transducers. In some embodiments, assembly 4 or enclosure 5 may be described as a two-way, dual or multi-way micro speaker assembly or enclosure. In some embodiments, driver 7 may have a moving mass of between 20 and 50 mg, and a coil mass of between 10 and 30 mg. In some embodiments, driver 10 may have a moving mass of between 40 and 100 mg, and a coil mass of between 20 and 80 mg.

Figure 5:
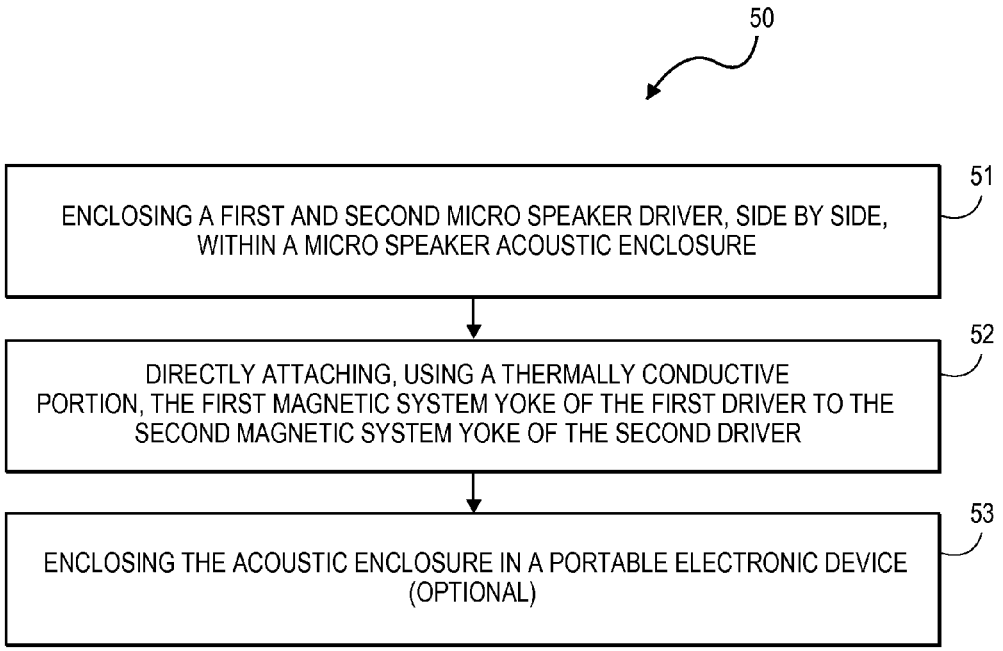
FIG. 5 shows a flow diagram of an example method of manufacturing the micro speaker assembly or mobile device that includes embodiments of two speaker drivers having their yokes thermally coupled by a thermally conductive portion or bridge.

FIG. 5 shows flow diagram of an example process 50 of manufacturing the micro speaker assembly or mobile device that includes embodiments of two speaker drivers having their yokes thermally coupled by a thermally conductive portion or bridge. Process 50 begins with block 51 where a first and second micro speaker driver are enclosed, side by side, within a micro speaker acoustic enclosure. Block 51 may include enclosing drivers 7 and 10, side by side, within micro speaker acoustic enclosure 5. In some cases, drivers 7 and 10 may be oriented in the same direction. Enclosing the drivers may include descriptions for FIGS. 1-4 for mounting or attaching the drivers to enclosure 5 (e.g., wall 19).

At block 52 the first magnetic system yoke of the first driver is directly attached to the second magnetic system yoke of the second driver. Block 52 may include directly physically or thermally attaching magnetic system yokes 9 and 12 with bridge 13. In some embodiments, block 52 may include thermally coupling, binding or bonding bridge 13 to magnetic system yokes 9 and 12. Block 52 may include directly attaching or binding, using a thermally conductive portion, yoke 9 and 12, in order to enhance heat transfer between the drivers 7 and 10. Directly attaching the yokes may include descriptions for FIGS. 1-4 for attaching yokes 9 and 12.

At optional block 53 the acoustic enclosure is enclosed in a portable electronic device. Block 53 may include enclosing enclosure 5 and/or assembly 4 in or within device 1, so that sound from drivers 7 and 10 can be output from port 3 to the ambient, outside of device 1. In some embodiments, block 53 may include enclosing acoustic enclosure 4 in a mobile telephone communications device, a smart phone, a personal digital media player, a tablet computer, a notebook computer, and a compact desktop computer. Block 53 is optional and is not performed in some embodiments. Enclosing enclosure 5 and/or assembly 4 in or within device 1 may include descriptions for FIGS. 1-4 for having enclosure 5 and/or assembly 4 within device 1.

Thus, embodiments have been described for providing devices, systems and methods for using a thermally conductive portion or bridge to directly attach a first driver yoke to a second driver yoke in order to enhance heat transfer between the first and second speaker drivers. These embodiments provide benefits such as reducing instance of or avoiding components of the driver (e.g., yokes, coils, diaphragms, etc.) or housing (e.g., walls, bonds, glue, mounting, etc.) exceeding a given temperature at which they may become damaged, inoperative or melt. They also provide benefits such as reducing instance of or avoiding the magnet unit (e.g., systems 22 and 27) exceeding a given temperature and becoming demagnetized which will result in terminal damage to the speaker driver. They also provide benefits such as improving power-handling in a two-way microspeaker module by allowing heat to be exchange for a hotter driver to a cooler driver. By exchanging the heat, more power can be used to drive the drivers, with less risk of damaging components of the driver or housing. They also provide benefits such as reducing the need for letting heat from the drivers escape at the product level (e.g., device 1). Thus, allowing the heat to escape does not need to impact 1) constrained product size or 2) flexes and other components that insulate the speaker enclosure from being in good thermal contact with elements that may act as a heat sink (perhaps the enclosure).

Figure 6:
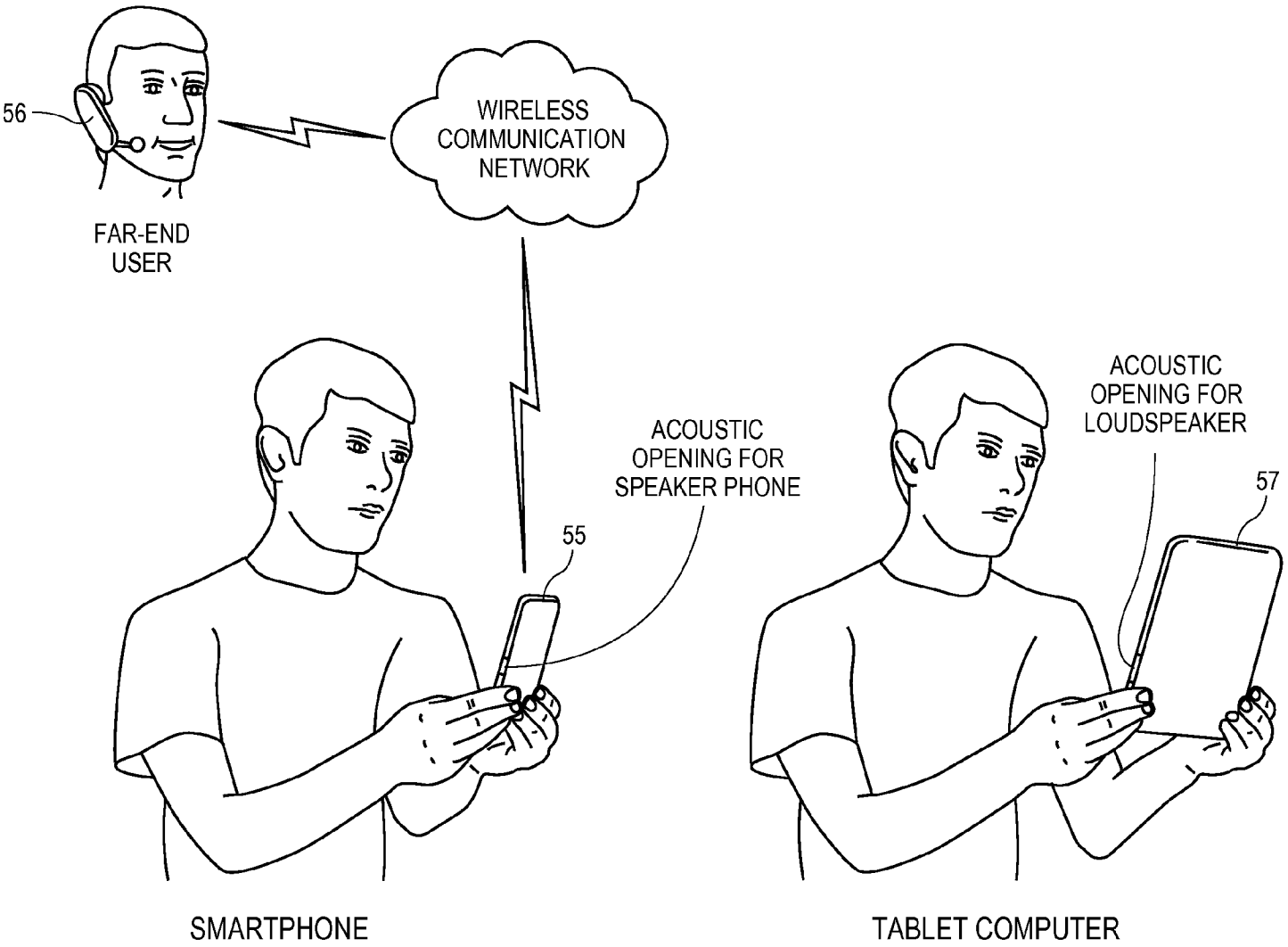
FIG. 6 depicts instances of portable consumer electronics devices in which embodiments of the invention may be implemented.

To conclude, various aspects of a micro speaker assembly that has yokes of two side by side drivers thermally coupled by a thermally conductive portion or bridge have been described. As explained above, an embodiment of the invention may be housed in a portable device such as a mobile telephone communications device, a smart phone, a personal digital media player, a tablet computer, a notebook computer, and a compact desktop. For example, FIG. 6 depicts instances of portable consumer electronics devices in which embodiments of the invention may be implemented. As seen in FIG. 6, the speaker assembly having yokes of two side by side drivers thermally coupled by a thermally conductive portion or bridge may included in a speakerphone unit that is integrated within a consumer electronic device 55 such as a smart phone with which a user can conduct a call with a far-end user of a communications device 56 over a wireless communications network. In another example, the speaker assembly may be integrated within the housing of tablet computer 57. These are just examples of where the speaker assembly may be used, it is contemplated, however, that the speaker assembly may be used with any type of electronic device in which it is desired to have a micro speaker assembly that has yokes of two side by side drivers thermally coupled, such as in a lap top computing device or portable headset such as device 56.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although embodiments of the micro speaker assembly described in FIGS. 1-6 include two speaker drivers, the assembly may contain 3 or more of such drivers, each driver having its yoke thermally coupled by a thermally conductive portion or bridge to at least one other driver yoke.

In addition, although embodiments of the micro speaker assembly described in FIGS. 1-6 include both of the drivers, diaphragms, or yokes are said to be oriented in a "parallel direction", it is considered that both may be in an orientation that is not said to be oriented in a "parallel direction", such as where the axis perpendicular to the surface of each is form an angle of between 5 and 170 degrees. The description is thus to be regarded as illustrative instead of limiting.

What is claimed is:

1. A micro speaker assembly comprising:

a speaker acoustic enclosure;

a first micro speaker driver located within the enclosure, the first micro speaker driver having a first magnetic system yoke;

a second micro speaker driver located within the enclosure and side by side with the first micro speaker driver, the second micro speaker driver having a second magnetic system yoke, wherein the first driver includes a first acoustic diaphragm and the second driver includes a separate, second acoustic diaphragm; and a thermally conductive portion that directly joins the first magnetic system yoke to the second magnetic system yoke in order to enhance heat transfer between the first micro speaker driver and the second micro speaker driver.

2. The assembly of claim 1, wherein the first and second drivers are oriented in a parallel direction.

3. The assembly of claim 1, wherein the first magnetic system yoke is coupled to a first speaker magnet system having a plurality of magnets that are disposed around a first voice coil, the first voice coil coupled to the first acoustic diaphragm;

wherein the second magnetic system yoke is coupled to a second speaker magnet system having a plurality of magnets that are disposed around a second voice coil, the second voice coil coupled to the second acoustic diaphragm;

wherein the second acoustic diaphragm is configured to provide a lower frequency output than the first acoustic diaphragm.

4. The assembly of claim 3, wherein a first end of the thermally conductive portion is disposed below an area between the plurality of magnets of the first speaker magnet system and a second end of the thermally conductive portion is disposed below an area between the plurality of magnets of the second speaker magnet system.

5. The assembly of claim 1, wherein the thermally conductive portion comprises a bar, bridge, or tie of one of a ferrous material, a metal material, a copper material, and a steel material.

6. The assembly of claim 1, wherein the thermally conductive portion, the first magnetic system yoke and the second magnetic system yoke are a single piece of ferrous material.

7. The assembly of claim 1, wherein the thermally conductive portion comprises a material and is configured to thermally connect the first magnetic system yoke to the second magnetic system yoke to cause heat to be transferred between the first and second micro speaker drivers.

8. The assembly of claim 1, wherein the bridge, the first magnetic system yoke and the second magnetic system yoke are a single piece of ferrous material.

9. The assembly of claim 1, wherein the thermally conductive portion extends between the first magnetic system yoke and the second magnetic system yoke.

10. A micro speaker assembly comprising:

a speaker acoustic enclosure; and a first micro speaker driver located within the enclosure, the first micro speaker driver having a first magnetic system yoke;

a second micro speaker driver located within the enclosure, side by side with the first micro speaker driver, the second micro speaker driver having a second magnetic system yoke, wherein the first driver includes a first acoustic diaphragm and the second driver includes a second acoustic diaphragm; and a thermally conductive bridge disposed between the first and second magnetic system yokes, the thermally conductive bridge directly joining and thermally coupled to adjacent corners of the first magnetic system yoke and the second magnetic system yoke in order to enhance heat transfer between the first and second yokes.

11. The assembly of claim 10, wherein the first and second drivers are oriented in a parallel direction.

12. The assembly of claim 10, wherein the second magnetic system yoke is adjacent to the first magnetic system yoke; wherein the second magnetic system yoke has a planar surface oriented parallel to a planar surface of the first magnetic system yoke; and wherein the thermally conductive bridge has a planar surface oriented parallel to the planar surface of the first and second magnetic system yokes.

13. The assembly of claim 10, wherein the first magnetic system yoke is coupled to a first speaker magnet system having a plurality of magnets that are disposed around a first voice coil, the first voice coil coupled to the first acoustic diaphragm;

wherein the second magnetic system yoke is coupled to a second speaker magnet system having a plurality of magnets that are disposed around a second voice coil, the second voice coil coupled to the second acoustic diaphragm;

wherein the second acoustic diaphragm is configured to provide a lower frequency output than the first acoustic diaphragm.

14. The assembly of claim 13, wherein an area of the first magnetic system yoke is smaller than an area of the second magnetic system yoke, wherein the first and second magnetic system yokes have a plurality of rounded edges, and wherein the bridge attaches opposing corners of the first and second magnetic system yokes.

15. The assembly of claim 13, wherein a first end of the bridge is disposed below an area between the plurality of magnets of the first speaker magnet system and a second end of the bridge is disposed below an area between the plurality of magnets of the second speaker magnet system.

16. The assembly of claim 10, wherein the micro speaker assembly is enclosed in a portable device, wherein the portable device is one of a mobile telephone communications device, a smart phone, a personal digital media player, a tablet computer, a notebook computer, and a compact desktop computer.

17. A micro speaker assembly comprising:

a speaker acoustic enclosure; and a first micro speaker driver located within the enclosure, the first micro speaker driver having a first magnetic system yoke;

a second micro speaker driver located within the enclosure, side by side with the first micro speaker driver, the second micro speaker driver having a second magnetic system yoke; and a thermally conductive bridge disposed between the first and second magnetic system yokes, the thermally conductive bridge directly joining and thermally coupled to adjacent corners of the first magnetic system yoke and the second magnetic system yoke in order to enhance heat transfer between the first and second magnetic system yokes, wherein the bridge, the first magnetic system yoke and the second magnetic system yoke are a single piece of ferrous material.

18. A portable consumer electronics device comprising:

an external housing in which a plurality of electronic components of the device, including a processor, data storage containing an operating system and application software for execution by the processor, a display panel, and an audio codec, are installed, the external housing including a micro speaker acoustic enclosure;

a first micro speaker driver located within the enclosure, the first micro speaker driver having a first magnetic system yoke, the first micro speaker driver to be driven by an audio signal from the audio codec;

a second micro speaker driver located within the enclosure and side by side with the first micro speaker driver, the second micro speaker driver having a second magnetic system yoke, the second micro speaker driver to be driven by an audio signal from the audio codec, wherein the first micro speaker driver includes a first acoustic diaphragm and the second micro speaker driver includes a second acoustic diaphragm; and a thermally conductive portion that directly joins the first magnetic system yoke to the second magnetic system yoke in order to enhance heat transfer between the first and second micro speaker driver.

19. The device of claim 18, wherein the device is one of a mobile telephone communications device, a smart phone, a personal digital media player, a tablet computer, a notebook computer, and a compact desktop computer.

20. A method comprising:

enclosing a first micro speaker driver and a second micro speaker driver, side by side, within a micro speaker acoustic enclosure, the first micro speaker driver having a first magnetic system yoke, the second micro speaker driver having a second magnetic system yoke, wherein the first driver includes a first acoustic diaphragm and the second driver includes a second acoustic diaphragm; and directly attaching, using a thermally conductive portion, the first magnetic system yoke to the second magnetic system yoke in order to enhance heat transfer between the first and second micro speaker drivers.

21. The method of claim 20, further comprising enclosing the acoustic enclosure in a portable device, wherein the portable device is one of a mobile telephone communications device, a smart phone, a personal digital media player, a tablet computer, a notebook computer, and a compact desktop computer.

* * * * *